US010626687B1

(12) United States Patent
Jeseritz

(10) Patent No.: US 10,626,687 B1
(45) Date of Patent: Apr. 21, 2020

(54) WEDGE SYSTEM TO EXTEND AND ELEVATE A PIPE HANDLER

(71) Applicant: Hawker Equipment Solutions, LLC., Litchfield, MN (US)

(72) Inventor: Michael R. Jeseritz, Litchfield, MN (US)

(73) Assignee: Hawker Equipment Solutions, LLC., Litchfield, MN (US)

( * ) Notice: Subject to any disclaimer, the term of this patent is extended or adjusted under 35 U.S.C. 154(b) by 0 days.

(21) Appl. No.: 16/132,328

(22) Filed: Sep. 14, 2018

(51) Int. Cl.
*E21B 19/14* (2006.01)
*E21B 19/15* (2006.01)

(52) U.S. Cl.
CPC ..... *E21B 19/155* (2013.01)

(58) Field of Classification Search
CPC ..... E04B 1/215; B65G 11/08; B65G 11/088; B65G 11/146; B28C 5/4251; Y10T 403/7079; E21B 19/155; E21B 15/003; F16L 1/065; F16L 1/10
USPC ..... 104/134, 69; 138/157, 158, 162; 14/69.5; 193/14, 27, 34, 38, 41, 6; 238/52, 256; 277/608; 403/315, 376; 52/223.11, 848, 849
See application file for complete search history.

(56) References Cited

U.S. PATENT DOCUMENTS 495,716 A 4/1893 Wilkinson
2,194,421 A * 3/1940 De Saussure, Jr. .. A47B 13/086 52/782.23
2,337,217 A * 12/1943 Williams ..... B65G 11/026 193/1
2,558,554 A * 6/1951 Harvey ..... E21B 19/155 414/22.61
2,577,926 A 12/1951 Stiles
2,628,725 A 2/1953 Stone
2,643,006 A 6/1953 King
2,880,881 A 4/1959 Robishaw
2,958,430 A 11/1960 Robishaw
RE24,907 E * 12/1960 Maydew ..... E21B 19/155 414/22.59

(Continued)

FOREIGN PATENT DOCUMENTS

CA 2224638 A1 6/1999
CA 2431213 C 10/2004

(Continued)

*Primary Examiner* — Gregory W Adams
(74) *Attorney, Agent, or Firm* — Albert W. Watkins

(57) ABSTRACT

A pipe handler trailer assists with the handling of very large and heavy pipes that are regularly raised to and lowered from an elevated surfaces. At least one wedge is removably coupled to an intermediate location within the pipe handler boom. The wedge is operative to change a longitudinal direction of the non-linear boom. The wedge has a pipe-receiving trough configured to cooperate with the pipe handler skidway and support pipes through longitudinal movement thereon. Front and rear faces are rigidly affixed to an undersurface of the wedge skidway, and are offset from parallel to each other. A pair of support hooks protrude from the wedge front face, and are designed to drop into and engage with a pair of mating slots. Once the support hooks are engaged with the slots, fasteners such as bolts and nuts are used to secure the wedge to the pipe handler boom.

20 Claims, 5 Drawing Sheets

(56) References Cited

U.S. PATENT DOCUMENTS 3,070,845 A * 1/1963 Cheskin ..... E04C 3/10 52/223.11
3,169,645 A * 2/1965 Freeman ..... E21B 19/155 414/22.59
3,177,944 A 4/1965 Knights
3,212,593 A 10/1965 Reischl
3,259,368 A 7/1966 Warnke
3,280,920 A 10/1966 Scott
3,539,024 A 11/1970 Irons et al.
3,559,821 A 2/1971 James
3,616,941 A 11/1971 Walling
3,633,771 A 1/1972 Woolslayer et al.
3,706,347 A 12/1972 Brown
3,716,149 A 2/1973 Scaggs
3,734,208 A 5/1973 Otto
3,743,078 A 7/1973 Pittoreau
3,750,804 A 8/1973 Lemelson
3,774,780 A 11/1973 Buffington
3,792,783 A 2/1974 Brown
3,810,553 A 5/1974 Crocker et al.
3,916,500 A 11/1975 Brown
3,937,334 A 2/1976 Bleyl et al.
3,991,887 A 11/1976 Trout
4,040,524 A 8/1977 Lamb et al.
4,053,063 A 10/1977 Harper, Jr.
4,081,087 A 3/1978 Freeman, Sr.
4,082,193 A 4/1978 Teague
4,134,501 A 1/1979 Tune
4,140,227 A 2/1979 Beck
4,235,566 A 11/1980 Beeman et al.
4,255,069 A 3/1981 Yielding
4,270,748 A * 6/1981 Ray ..... A63G 21/00 472/116
4,368,602 A 1/1983 Manten
4,371,302 A 2/1983 Frias et al.
4,379,676 A 4/1983 Frias
4,382,738 A 5/1983 Frias
4,386,883 A 6/1983 Hogan et al.
4,403,898 A 9/1983 Thompson
4,426,182 A 1/1984 Frais et al.
4,439,091 A 3/1984 Frias
4,453,872 A 6/1984 Frias et al.
4,470,740 A 9/1984 Frias
4,474,520 A 10/1984 Buckner et al.
4,492,502 A 1/1985 Delano
4,494,899 A 1/1985 Hoang et al.
4,616,960 A * 10/1986 Gladish ..... B65G 51/03 406/88
4,684,314 A 8/1987 Luth
4,712,264 A * 12/1987 Voith ..... A61G 3/061 14/69.5
4,815,712 A 3/1989 Kawada
5,012,898 A 5/1991 Tsymberov
5,190,122 A 3/1993 Fletcher et al.
5,320,208 A 6/1994 Mason
5,427,574 A * 6/1995 Donnelly-Weide .... A63G 21/00 104/69
5,481,769 A 1/1996 Schneider
5,915,882 A 6/1999 Darwiche et al.
6,079,925 A 6/2000 Morgan et al.
6,085,852 A 7/2000 Sparks et al.
6,705,414 B2 3/2004 Simpson et al.
6,899,510 B2 5/2005 Morelli et al.
7,021,880 B2 4/2006 Morelli et al.
7,163,367 B2 1/2007 Handley
7,473,065 B2 1/2009 Wells
7,635,249 B2 12/2009 Guidroz
7,665,944 B2 2/2010 Guidroz
7,744,327 B2 6/2010 Lops et al.
7,992,646 B2 8/2011 Wright et al.
D644,697 S * 9/2011 Mimlitch, III ..... D21/565
8,052,368 B2 11/2011 Littlewood et al.
8,806,820 B2 * 8/2014 Ahn ..... B28B 1/002 52/223.11
8,840,352 B2 * 9/2014 Taggart ..... E21B 19/155 414/22.54
8,910,336 B2 * 12/2014 Han ..... E01D 2/02 14/74.5
9,308,460 B1 * 4/2016 Chin ..... A63G 21/04
9,388,647 B2 7/2016 Dahmes et al.
9,518,432 B2 * 12/2016 Miranda ..... E21B 19/155
9,845,646 B2 12/2017 Dahmes et al.
2004/0136813 A1 7/2004 Pietras
2005/0079044 A1 4/2005 Handley
2006/0104746 A1 5/2006 Thompson
2008/0185258 A1 * 8/2008 DeCollibus ..... B28C 5/4251 193/6
2008/0263990 A1 10/2008 Morelli et al.
2009/0272235 A1 11/2009 Berry
2014/0238745 A1 8/2014 Dahmes et al.
2015/0008038 A1 1/2015 Folk
2015/0167299 A1 * 6/2015 Trubnikow ..... E04B 1/36 52/848
2016/0319612 A1 11/2016 Dahmes et al.
2017/0328146 A1 11/2017 Meuth et al.

FOREIGN PATENT DOCUMENTS

WO WO 2014172690 A2 10/2014
WO WO 2017196467 A1 11/2017

* cited by examiner

WEDGE SYSTEM TO EXTEND AND ELEVATE A PIPE HANDLER

BACKGROUND OF THE INVENTION

1. Field of the Invention

This invention pertains generally to material or article handling, and more particularly to a pipe handler such as might commonly be used in the oil drilling and rigging industry and in the well servicing industry to assist with the handling of very large and heavy pipes that are regularly raised to and lowered from an elevated drilling platform.

2. Description of the Related Art

In the oil drilling and rigging industry, drilling platforms commonly referred to as derricks are assembled above the earth. These derricks facilitate the drilling and installation of wells. The platform or work floor typically may be elevated many feet above the ground.

Drill strings of very large and heavy pipes are assembled or disassembled on the derrick. For exemplary and non-limiting purposes, these pipes may be stored horizontally on or near the ground adjacent to the derrick. This means that these very large and heavy pipes must be re-oriented from horizontal to more nearly vertical orientation, and raised from near ground level to several tens of feet into the air. Consequently, the handling of these large and heavy pipes is not suited to manual labor, and instead requires mechanical assistance.

Pipe handlers are commonly used to assist with the handling of these very large and heavy pipes that are regularly raised and lowered from an elevated drilling platform. A large number of patents are exemplary of this technology, and provide the background for the basic features, while also contrasting with the novel features of the present invention. These U.S. patents, the contents and teachings which are incorporated herein by reference, include: U.S. Pat. No. 2,643,006 by King, entitled "Automatic pipe handler," that illustrates an early automatic pipe handler, and describes a bumper or stop having a resilient portion in the form of a rubber or spring against which the drill pipe may abut, that prevents a pipe section from sliding down the dolly. U.S. Pat. No. 3,792,783, entitled "Pipe Handling System" and U.S. Pat. No. 3,916,500 entitled "Pipe handling apparatus", each by Cicero C. Brown, the contents and teachings which are incorporated herein by reference, describe another early automatic pipe handler having an endless cable or chain driving a lug to elevate a pipe in a trough to push the pipe toward the derrick. This same lug is also used to control the rate of descent of the pipe. U.S. Pat. No. 4,386,883 by Hogan et al, entitled "Materials lifting apparatus" and U.S. Pat. No. 4,494,899 by Hoang et al, entitled "Pipe trough for transporting pipe between upper and lower positions", the contents and teachings which are incorporated herein by reference, each describe automatic pipe handlers with kickers to assist with the loading and unloading of pipes. Hogan refers to these kickers as pipe ejecting assemblies that eject the pipe from the carriage using an arm and a ram, and Hoang et al refers to these as unloading arms for ejecting the pipe from the trough. Hoang et al also describe pipe loading arms to assist with loading pipe into the trough. U.S. Pat. No. 4,235,566 by Beeman et al, entitled "Pipe-conveying catwalk" and U.S. Pat. No. 4,439,091 by Frias, entitled "Pipe feeding system", the contents and teachings which are incorporated herein by reference, each illustrate carriages that move along a trough. The teachings and content of U.S. Pat. No. 3,559,821 by James, entitled "Drill Pipe Handling Apparatus" and which illustrates another drill pipe handling apparatus, is additionally incorporated herein by reference.

Additional U.S. patents illustrating various kicker constructions, the teachings and contents which are incorporated herein by reference, include: U.S. Pat. No. 4,140,227 by Beck, entitled "Cable way apparatus for transporting pipe"; and U.S. Pat. No. 4,403,898 by Thompson, entitled "Pipe pick-up and laydown machine". Additional patents showing rigid pipe handler structures, the teachings and contents which are incorporated herein by reference, include: U.S. Pat. No. 2,880,881 by Robishaw, entitled "Unitized pipe rack"; U.S. Pat. No. 2,958,430 by Robishaw, entitled "Pipe rack and lay-down trough"; U.S. Pat. No. 4,684,314 by Luth, entitled "Pipe handling apparatus"; U.S. Pat. No. 6,079,925 by Morgan et al, entitled "Method and apparatus for lifting oilfield goods to a derrick floor"; U.S. Pat. No. 7,635,249 by Guidroz, entitled "Pipe pick-up and laydown apparatus"; U.S. Pat. No. 7,665,944 by Guidroz, entitled "Pipe pick-up and laydown apparatus and method"; U.S. Pat. No. 7,992,646 by Wright et al, entitled "Horizontal offline stand building system"; and U.S. Pat. No. 8,052,368 by Littlewood et al, entitled "Catwalk for a drilling rig".

Other relevant patents and published applications, the teachings and contents which are incorporated herein by reference, include: U.S. Pat. No. 6,899,510 by Morelli et al, entitled "Pipe handling system for presenting sections of pipe to a derrick work floor having a pipe ejection assembly"; U.S. Pat. No. 7,021,880 by Morelli et al, entitled "Pipe handling apparatus for presenting sections of pipe to a derrick work floor having a high-speed carriage assembly"; and 2008/0263990 by Morelli et al, entitled "Skidding system for a catwalk".

From these foregoing patents, the basic structure of a pipe handler and the function thereof will be well understood.

As beneficial and effective as the foregoing patents are at facilitating the handling of pipes, challenging terrain and newer designs for the drilling platforms and equipment demand an ability to service platforms at greater elevation than heretofore required. In addition to some of the aforementioned patents, several artisans have developed equipment better able to handle variable heights. One such U.S. patent, the teachings which are incorporated herein by reference, is U.S. Pat. No. 7,163,367 by Handley, entitled "Multi-position height adjustment system for a pipe handling apparatus". The present applicant also commonly owns U.S. Pat. Nos. 9,388,647 and 9,845,646, the teachings and contents which are incorporated herein by reference. These patents illustrate novel height adjustment assemblies to set the maximum height that the skidway or trough, also sometimes referred to as the boom, will reach when the hydraulic lift cylinder is fully extended. Nevertheless, there are times where even greater adaptability is highly beneficial.

In U.S. Pat. No. 8,840,352 by Taggart et al, entitled "Apparatus and method for handling pipe," the teachings which are incorporated herein by reference, a plurality of trough segments are pivotally interconnected and suspended to provide an angular transition in the skidway, to transition the skidway from a horizontal position to an inclined position. While this approach provides more flexibility in reaching a target elevation at the platform, the apparatus is much more permanently constructed on site, and so is not easily lowered from the platform and moved about. Further, the apparatus is relatively complex to assemble.

As may be apparent, in spite of the enormous advancements and substantial research and development that has been conducted, there still remains a need for a pipe handler that is more adaptable to different platform elevations without sacrificing the ease of set-up, take-down, and transport provided for exemplary purpose in the present applicant's U.S. Pat. Nos. 9,388,647 and 9,845,646 incorporated herein above by reference.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a wedge configured to removably couple to an intermediate location within a pipe handler skidway and change the longitudinal direction of the skidway. A wedge skidway has a pipe-receiving trough configured to cooperate with the pipe handler skidway and support pipes through longitudinal movement thereon. A rear face is rigidly affixed to an undersurface of the wedge skidway. A front face is spaced from the rear face and displaced from parallel to the rear face. At least one support hook protrudes from the front face. At least one opening in the rear face is complementary to the at least one support hook and is configured to receive and engage with a support hook of like geometry to the at least one support hook.

In a second manifestation, the invention is a pipe handler that has a non-linear skidway. A supporting carriage supports at least a first end of the skidway. A lift arm is pivotally coupled to the supporting carriage adjacent a first terminus and is pivotal with respect to the supporting carriage about an axis transverse to a longitudinal axis of the skidway. A drive is operative to reposition the lift arm. A wedge is secured to an intermediate location within the pipe handler non-linear skidway, separates a first portion of the skidway from a second portion of the skidway, and is operative to change a longitudinal direction of the second skidway portion from a longitudinal direction of the first skidway portion. The wedge has a wedge skidway having a pipe-receiving trough configured to cooperate with the pipe handler skidway and support pipes through longitudinal movement thereon; a rear face rigidly affixed to an undersurface of the wedge skidway; a front face spaced from the rear face and displaced from parallel to the rear face. A first removable fastener rigidly secures the wedge front face to the first portion of the skidway, and a second removable fastener rigidly secures the wedge rear face to the second portion of said skidway.

In a third manifestation, the invention is a wedge configured to removably couple to a location intermediate within a pipe handler skidway. The wedge separates a first portion of the skidway from a second portion of the skidway, and further configured to direct a longitudinal axis of the second skidway portion to a non-parallel alignment relative to a longitudinal axis of the first skidway portion. The wedge has a wedge skidway having a pipe-receiving trough configured to cooperate with the pipe handler skidway and support pipes through longitudinal movement thereon; a generally planar rear face rigidly affixed to an undersurface of the wedge skidway; and a generally planar front face spaced from the rear face and displaced from parallel to the generally planar rear face.

OBJECTS OF THE INVENTION

Exemplary embodiments of the present invention solve inadequacies of the prior art by providing a wedge removably coupled to an intermediate location within a pipe handler boom. The wedge is operative to change a longitudinal direction of the portion of the boom extending from the wedge. The wedge has a pipe-receiving trough configured to cooperate with the pipe handler skidway and support pipes through longitudinal movement thereon. Front and rear faces are rigidly affixed to an undersurface of the wedge skidway, and are offset from parallel to each other. A pair of support hooks protrude from the wedge front face, and are designed to drop into and engage with a pair of mating slots. Once the support hooks are engaged with the slots, fasteners such as bolts and nuts are used to secure the wedge to the pipe handler boom.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to selectively enable a pipe handler boom to reach greater heights. A second object of the invention is to enable a single installer to easily insert a wedge within the pipe handler boom to redirect the boom. Another object of the present invention is to provide intuitive installation of the wedge. A further object of the invention is to maintain the continuity of the pipe trough or skidway, to reduce the likelihood of binding of the pipe therein. Yet another object of the present invention is to achieve the foregoing objectives with a wedge geometry that has few piece parts and which is readily manufactured

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 7:
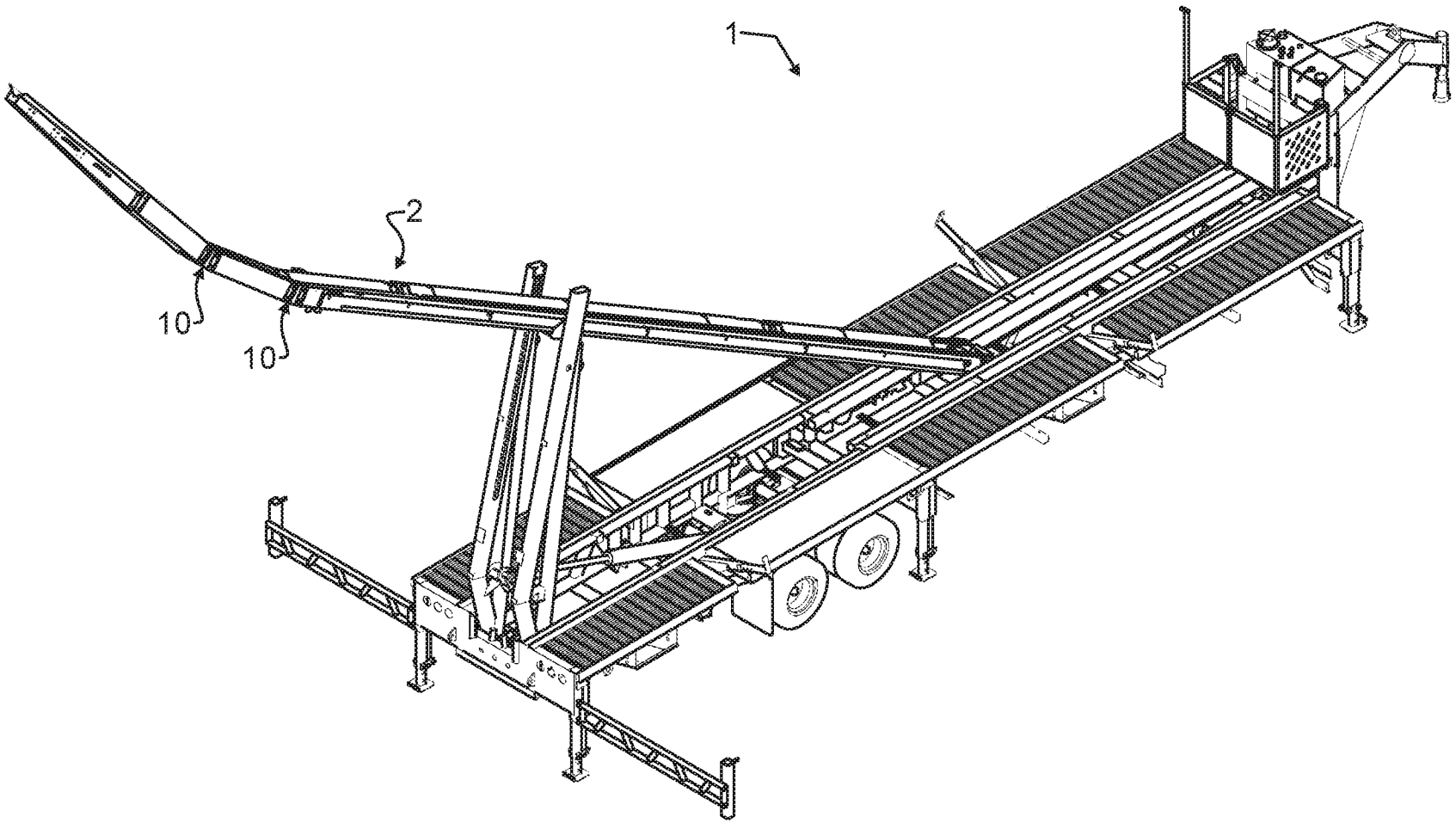
FIG. 7 illustrates the preferred embodiment wedge of FIG. 1 in further combination with a pipe handler to extend and elevate the pipe handler, illustrated from an isometric view with the skidway elevated.
Figure 8:
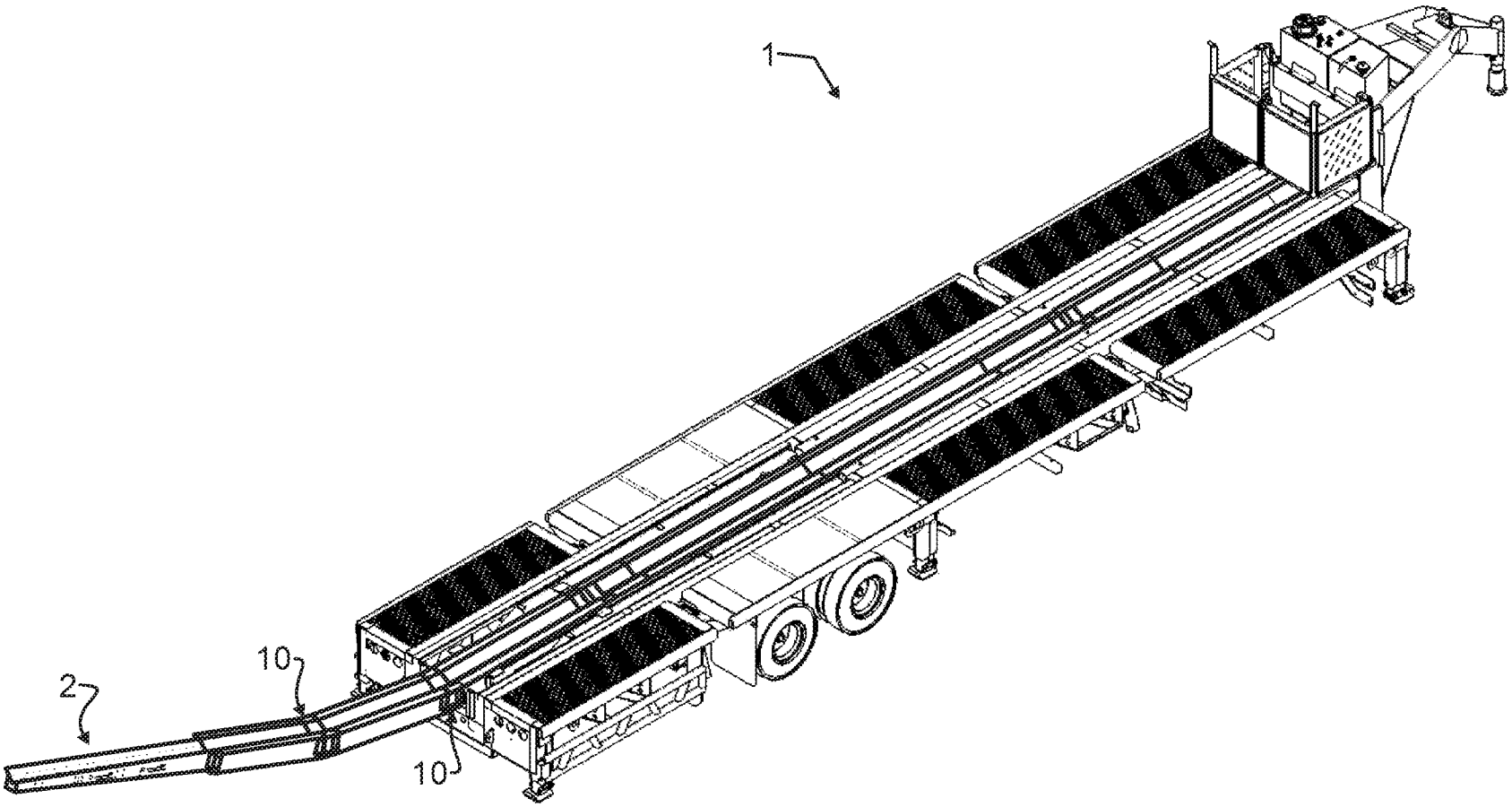
FIG. 8 illustrates the combination preferred embodiment wedge and pipe handler of FIG. 7, illustrated from an isometric view with the skidway lowered such as for transport or storage.

Manifested in the preferred embodiment, the present invention provides a pipe handler trailer 1 such as illustrated in FIGS. 7 and 8 that may for exemplary purpose be used in the oil drilling and rigging industry and in the well servicing industry to assist with the handling of very large and heavy pipes that are regularly raised to and lowered from an elevated drilling platform. For exemplary and non-limiting purpose, a suitable trailer that may be used is described in more detail in the present applicant's U.S. Pat. Nos. 9,388,647 and 9,845,646 incorporated herein above by reference. While a trailer is not critical to the operation of the invention, and so the pipe handler apparatus could conceivably be provided on a self-propelled vehicle such as a truck, or alternatively provided on a fixed structure without wheels, the provision of various trailer components such as a tongue assembly with hitch, wheels, support legs, and trailer undercarriage are illustrated in FIGS. 7-8 to allow the preferred embodiment pipe handler trailer 1 to be transported conveniently to more than one drilling derrick. If a self-propelled vehicle such as truck were used, then the capital investment in the drive train and cab is tied up in the apparatus, and, since the pipe handler may be left at a single platform for extended periods, the drive train and cab are unavailable for use. Instead, the preferred embodiment pipe handler trailer 1 may be quickly anchored by dropping support legs, which will preferably be independently adjustable to accommodate uneven surfaces, and then quickly disconnecting the hitch from a towing vehicle. The towing vehicle is then free for other productive use.

The trailer top includes a deck which in the preferred embodiment may be provided with one or more small gaps within which are provided pick-up and indexing arms that facilitate the loading of pipes onto the deck. A motor, hydraulic pump and associated controls and components may be provided, though any suitable source of energy and motive power may be provided within the constraints of the present invention.

A boom 2 contains a skidway or trough for receiving and holding a pipe during conveyance. The elevation of boom 2, and therefore of the skidway, whether nested within deck or angled upward and rearward therefrom, is controlled by a boom lift. FIG. 7 illustrates the skidway elevated, as it would be when actively transferring pipe to or from a platform. FIG. 8 illustrates the skidway lowered, such as for pipe loading, trailer transport, or storage. When stored, such as during periods of non-use or during transport, boom 2 will preferably nest within the deck. Likewise, when a pipe is being loaded from the deck into the trough, boom 2 will also be lowered and nested within the deck.

The trough may be sized for a single pipe diameter, but will more typically be dimensioned to support the largest pipe for which the pipe handler trailer 1 is designed to accommodate. Various apparatus known in the art may optionally be provided to better secure, retain or hold pipes, whether the maximum size or smaller, safely in the trough, including various hoops, covers or the like.

Adjacent to the forward end of the trailer and positioned to roll along the top surface of the trough is a skate. The skate may preferably be provided with a cradle which holds one end of a pipe, and also with a backstop which preferably rises above the cradle to engage the end of a pipe along a transverse plane. This allows the skate to cradle and move a pipe along the trough, to raise or lower the pipe relative to the trailer deck. The skate is driven longitudinally along the trough by a drive, as described in greater detail in the present applicant's U.S. Pat. Nos. 9,388,647 and 9,845,646 incorporated herein above by reference.

Within the longitudinal course of boom 2, there are provided one or more preferred embodiment wedges 10. As visible in FIGS. 7 and 8, each one of these wedges will preferably provide a small angular change in the direction of the skidway. The degree of angular change will be selected by a designer for a particular intended application. However, in preferred embodiment wedges 10, the extent of angular deviation will only be a few degrees, most preferably less than twenty. Rather than provide a single large angular deviation, several discrete changes in direction are preferred. This is done to reduce wear, and avoid binding of pipe along the skidway. In consideration thereof, and again as visible in FIGS. 7 and 8, two or more wedges 10 may be provided along the longitudinal course of boom 2.

Preferred embodiment wedge 10 has a skidway 20 that will preferably have a geometry transverse to the longitudinal direction of boom 2 that aligns with the rest of the skidway on boom 2. Consequently, there will preferably be a trough 21 that for exemplary and non-limiting purpose might comprise the illustrated V-shape. Skidway 20 is supported by and may be rigidly affixed with rear face 30 and front face 40, and sides 50, 70.

Figure 1:
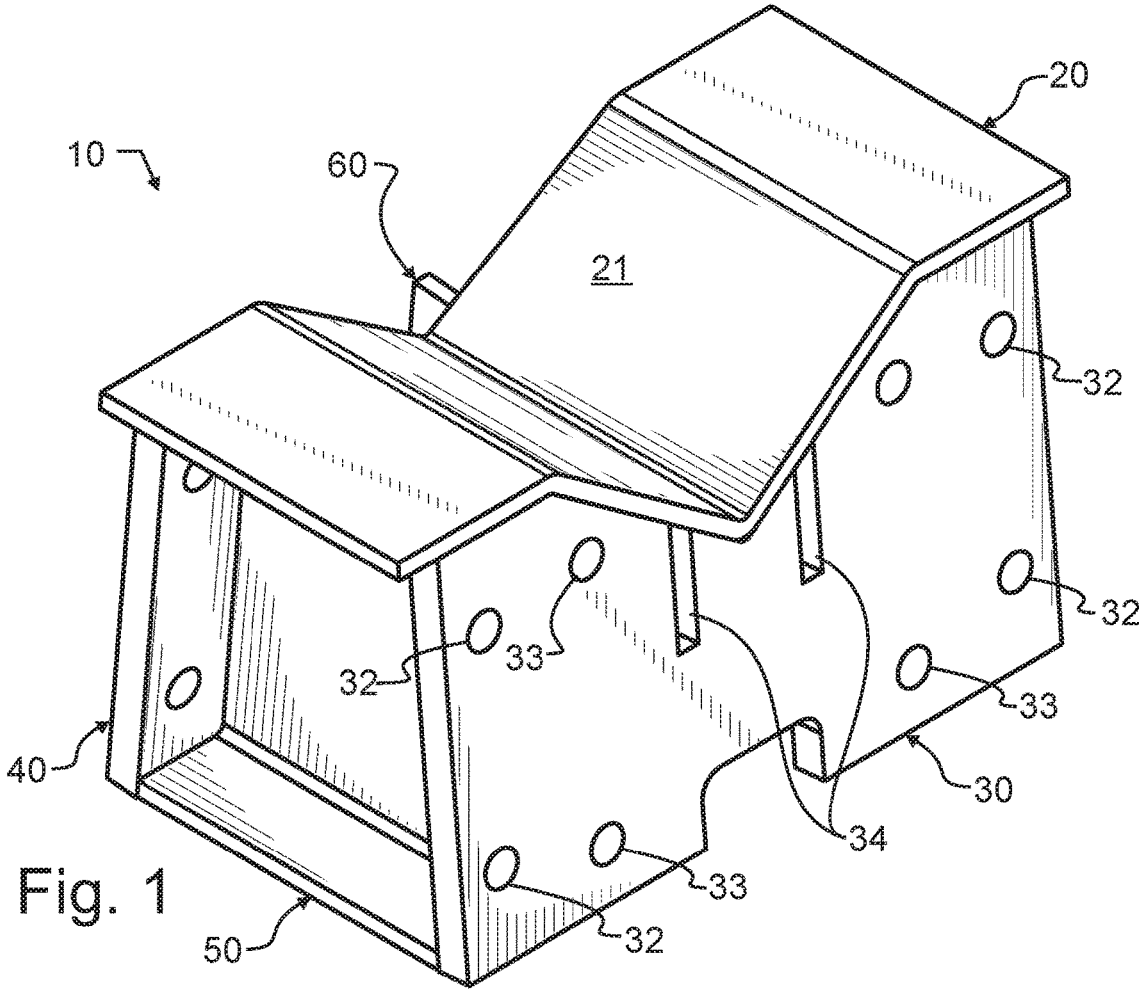
FIG. 1 illustrates a preferred embodiment wedge designed in accord with the teachings of the present invention and configured for use in combination with a pipe handler to extend and elevate the pipe handler, illustrated from an isometric view.
Figure 2:
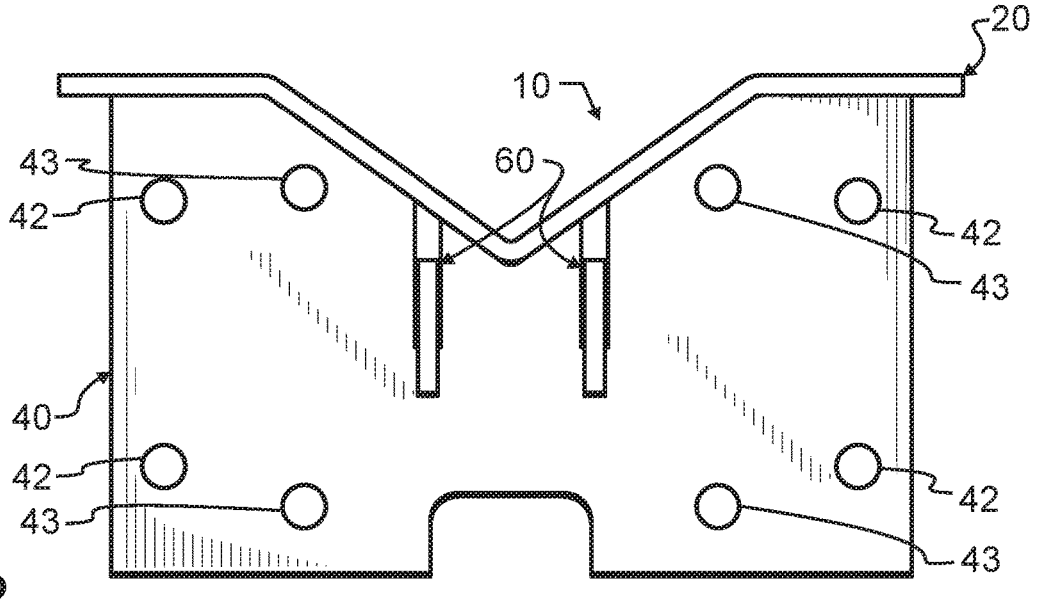
FIG. 2 illustrates the preferred embodiment wedge of FIG. 1 from a front elevational view.
Figure 3:
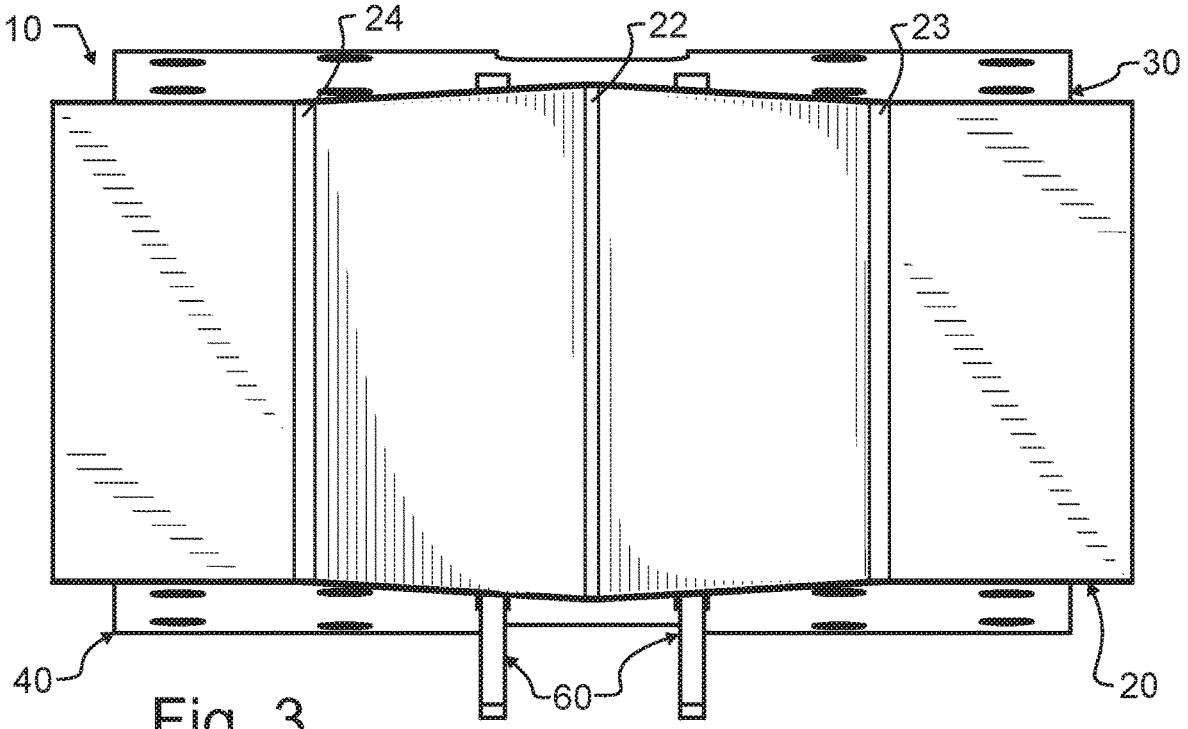
FIG. 3 illustrates the preferred embodiment wedge of FIG. 1 from a top plan view.

Owing to the angular change in the longitudinal axis of boom 2, if the transverse edges of skidway 20 were perpendicular to the edges that extend parallel to the longitudinal axis of boom 2, then there would be a small gap in the skidway that could potentially and very undesirably snag a pipe traveling along the skidway. To reduce the likelihood of snagging, the edges of skidway 20 in the region of trough 21 are not linear from side to side. Instead, and as visible in FIG. 3, the longitudinal extent of skidway 20 along the trough bottom 22 is greater than the longitudinal extent of trough top edges 23, 24. Said another way, the edge of skidway 20 between trough bottom 22 and trough top edge 23 is not parallel to the edge of skidway 20 between trough bottom 22 and trough top edge 24. Instead, there is an obtuse angle therebetween. Again, this is visible in FIG. 3, even though the obtuse angle only deviates from linear by a few degrees.

Figure 4:
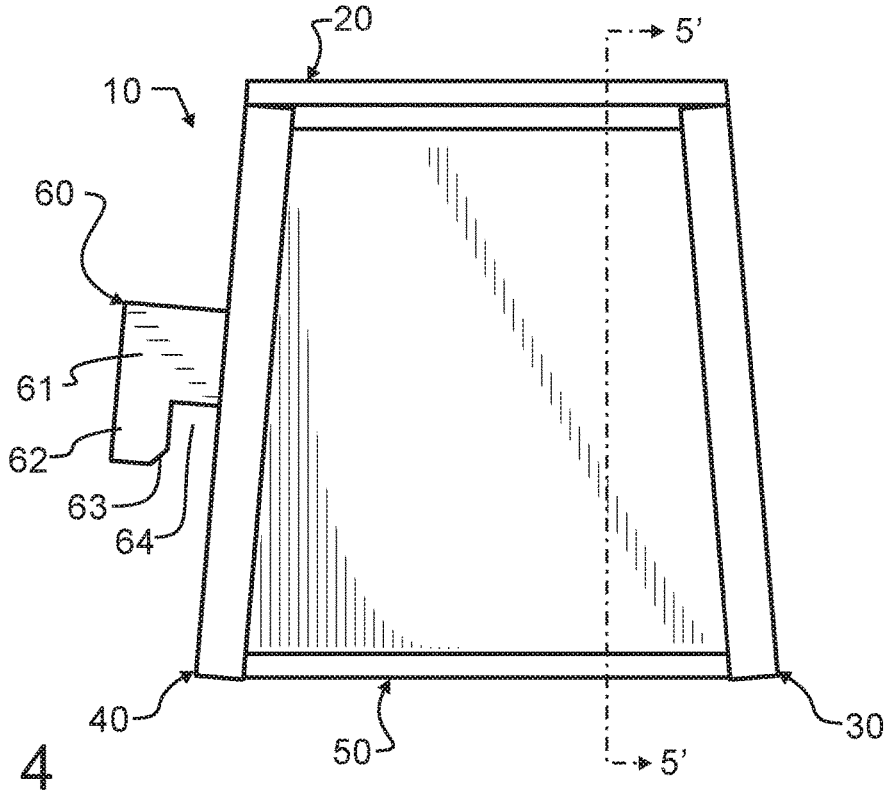
FIG. 4 illustrates the preferred embodiment wedge of FIG. 1 from a right side elevational view.

As best visible in FIG. 4, rear face 30 and front face 40 are preferably generally planar and spaced from each other. They are also not parallel, and instead are angularly offset. It is this offset from parallel that creates the small angular change in the direction of the skidway referred to herein above.

Extending from front face 40 are a pair of L-shaped support hooks 60, while rear face 30 has a pair of slots 34 formed therein and passing entirely through. Slots 34 are most preferably complementary to L-shaped support hooks 60, as will be described further herein below. A plurality of holes 32, 33 are preferably provided passing entirely through rear face 30, and complementary holes 42, 43 are provided passing entirely through front face 40.

Figure 5:
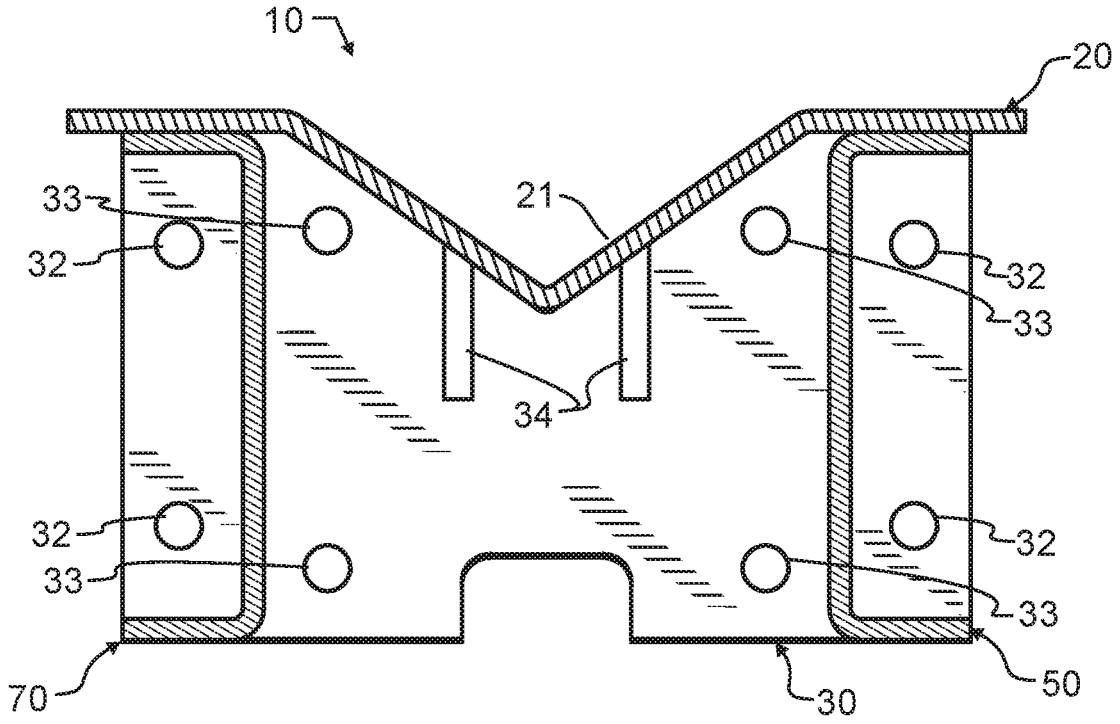
FIG. 5 illustrates the preferred embodiment wedge of FIG. 1 from a sectional view taken along section line 5' of FIG. 4.
Figure 6:
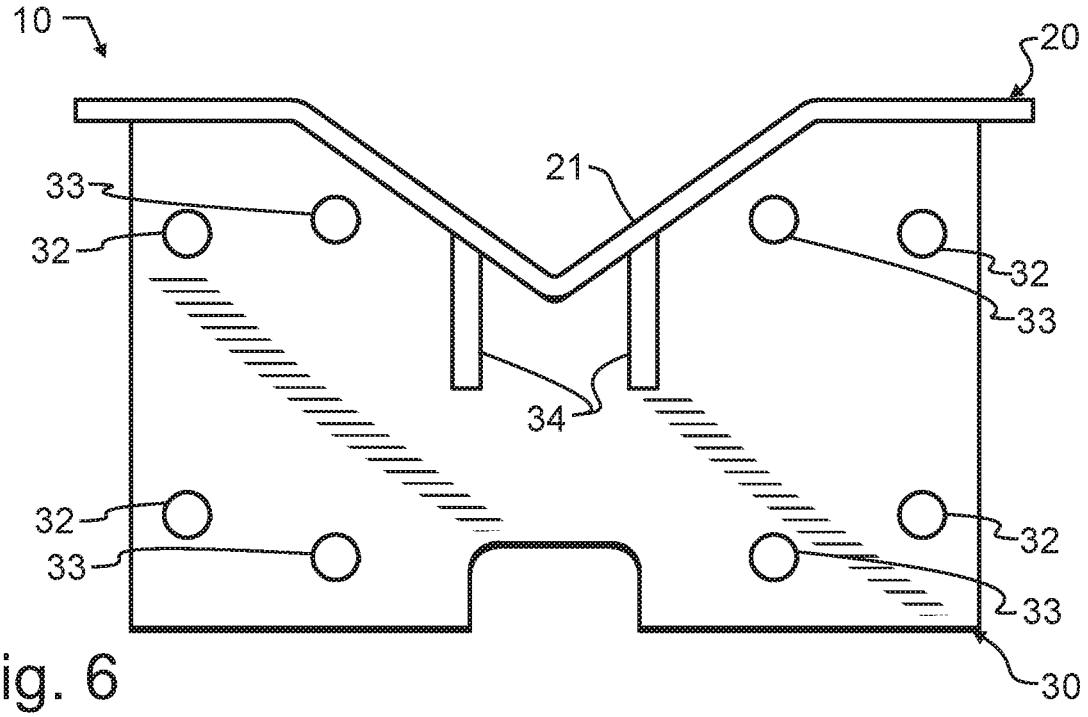
FIG. 6 illustrates the preferred embodiment wedge of FIG. 1 from a rear elevational view.

As best visible in FIG. 5, sides 50 and 70 are preferably formed from U-channel, and are rigidly affixed to rear face 30 and front face 40 on distal longitudinal ends.

When each of the components are constructed as illustrated in FIGS. 1-6 and securely affixed together such as by welding or other suitable technique, wedge 10 will define a very strong and rigid body well suited for supporting and conveying heavy pipe.

To install a preferred embodiment wedge 10 into boom 2, preferred embodiment wedge 10 may be lifted by an installer grasping with one hand on each respective end of skidway 20 adjacent to sides 50, 70. The installer will then engage the pair of L-shaped support hooks 60 into slots resembling slots 34 that are provided in the end of an existing pipe handler such as illustrated in the present applicant's commonly owned U.S. Pat. Nos. 9,388,647 and 9,845,646 incorporated by reference herein above. This temporarily supports preferred embodiment wedge 10 from the end of the pipe handler boom. Suitable fasteners, for exemplary and non-limiting purpose such as bolts, are then passed through holes 42 and 43 into holes like holes 32, 33 found on the end of boom 2. The bolts are then secured with nuts to rigidly secure preferred embodiment wedge 10 to the pipe handler. Holes 42 are open from the side, owing to the U-shape of sides 50, 70. In addition, the bottom of preferred embodiment wedge 10 is open, allowing an installer to access holes 43 from beneath. As a result of this installation, trough 20 will most preferably align with and extend the pipe trough of the pipe handler.

Since holes 32, 33 are complementary to holes 42, 43, additional preferred embodiment wedges 10 and other boom extensions and components may be similarly installed. While it is conceivable that an installer may stack two preferred embodiment wedges 10 immediately adjacent, as noted herein above the greater resultant local angle change may be undesirable in many instances.

As may be apparent, L-shaped support hooks 60 and slots 34 provide for simple and intuitive installation, allowing preferred embodiment wedge 10 to be lifted while aligning L-shaped support hooks 60 with slots 34, and then pushed, driving L-shaped support hooks 60 into slots 34. Preferably the installer will push until front face 40 engages with the mating face of the end of boom 2, providing ready tactile confirmation that L-shaped support hooks 60 have been slid fully into slots 34. Once L-shaped support hooks 60 slide into slots 34, the installer can either release or lower preferred embodiment wedge 10, allowing L-shaped support hooks 60 to firmly engage with slots 34. This is achieved by hook shaft 61 passing over the bottom edge of the mating slot, with hook end 62 engaging the face of the end of boom 2 opposed to or distal from front face 40. The engagement gap 64 is preferably sized to be just slightly larger than but approximately the same dimension as the thickness of the end of boom 2. Sloped taper 63 may optionally be provided such that if the installer fails to fully insert L-shaped support hooks 60 into slots 34, then as they lower preferred embodiment wedge 10, taper 63 will help to engage the face of the end of boom 2 opposed to or distal from front face 40 thereby pulling preferred embodiment wedge 10 closer to the end of boom 2.

In the unlikely event that fasteners are improperly installed and loosen, or otherwise fail, the combination of L-shaped support hooks 60 and slots 34 will act to preserve the integrity of boom 2, preventing catastrophic failure. Further, this combination also greatly facilitates disassembly, since the fasteners may be removed completely prior to separation. Then preferred embodiment wedge 10 may be manually or otherwise lifted and separated from the end of boom 2 without requiring awkward and potentially dangerous simultaneous manipulation of fasteners.

While L-shaped support hooks 60 and slots 34 are most preferred, other equivalent tool-free and manual techniques of fastening two objects together are known in the mechanical arts, and will be understood to be incorporated herein. Furthermore, in some alternative embodiments L-shaped support hooks 60 and slots 34 may be left out completely. In such embodiments, an installer will then need to simultaneously support and align wedge 10 relative to boom 2 while also engaging suitable fasteners, such as through the insertion of bolts into holes 32, 33, 42, and 43.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A wedge configured to removably couple to an intermediate location within a pipe handler skidway and change the longitudinal direction of the skidway, comprising:

a wedge skidway having a pipe-receiving trough configured to cooperate with said pipe handler skidway and support pipes through longitudinal movement thereon;

a rear face rigidly affixed to an undersurface of said wedge skidway;

a front face spaced from said rear face and displaced from parallel to said rear face;

at least one support hook protruding from said front face; and at least one opening in said rear face complementary to said at least one support hook and configured to receive and engage with a support hook of like geometry to said at least one support hook;

wherein said at least one support hook further comprises a hook shaft and a hook end angularly offset from said hook shaft, thereby defining an L-shaped geometry, said hook end displaced from said front face and thereby defining an engagement gap between said front face and said hook end; and wherein said at least one support hook further comprises a sloped taper at an end of said hook end distal to said hook shaft.

2. The wedge of claim 1, wherein said front face is generally planar.

3. The wedge of claim 2, wherein said rear face is generally planar.

4. The wedge of claim 1, wherein said rear face further comprises a slot of geometry complementary to said at least one support hook, and thereby configured to receive a support hook of geometry similar to said at least one support hook therein.

5. The wedge of claim 1, wherein said rear face further comprises at least one hole, and said front face further comprises at least one hole generally aligned with said rear face at least one hole.

6. The wedge of claim 5, wherein said at least one rear face hole further comprises at least two rear face holes, and said at least one front face hole further comprises at least two front face holes.

7. The wedge of claim 6, further comprising at least one side rigidly affixed to an undersurface of said wedge skidway, affixed to said front face between said at least two front face holes, and affixed to said rear face between said at least two rear face holes.

8. The wedge of claim 1, wherein said at least one side further comprises a U-shaped geometry having a first lip affixed to said wedge skidway.

9. The wedge of claim 1, wherein said pipe-receiving trough defines a trough first axis extending in a direction generally parallel to said pipe longitudinal movement within said pipe-receiving trough, and said pipe-receiving trough further comprises a trough bottom, trough side walls, and trough top edges distal in said trough from said trough bottom, said trough bottom extending parallel to said trough first axis by a distance greater than a distance of extent of said trough top edges parallel to said trough first axis.

10. A pipe handler having a non-linear skidway, comprising:

a supporting carriage supporting at least a first end of said skidway;

a lift arm pivotally coupled to said supporting carriage adjacent a first terminus and pivotal with respect to said supporting carriage about an axis transverse to a longitudinal axis of said skidway;

a drive operative to reposition said lift arm;

a wedge secured at an intermediate location within said pipe handler non-linear skidway and separating a first portion of said skidway from a second portion of said skidway and further configured to change a longitudinal direction of said second skidway portion from a longitudinal direction of said first skidway portion, said wedge having:

a wedge skidway having a pipe-receiving trough configured to cooperate with said pipe handler skidway and support pipes through longitudinal movement thereon;

a rear face rigidly affixed to an undersurface of said wedge skidway; and a front face spaced from said rear face and displaced from parallel to said rear face;

a first removable fastener rigidly securing said wedge front face to a first portion of said skidway; and a second removable fastener rigidly securing said wedge rear face to a second portion of said skidway.

11. The pipe handler of claim 10, further comprising:

at least one support hook protruding from said front face; and at least one opening in said rear face complementary to said at least one support hook and configured to receive and engage with a support hook of like geometry to said at least one support hook.

12. The pipe handler of claim 11, wherein said at least one support hook further comprises a hook shaft and a hook end angularly offset from said hook shaft, thereby defining an L-shaped geometry, said hook end displaced from said front face and thereby defining an engagement gap between said front face and said hook end.

13. The pipe handler of claim 12, wherein said at least one support hook further comprises a sloped taper at an end of said hook end distal to said hook shaft.

14. The pipe handler of claim 11, wherein said rear face further comprises a slot of geometry complementary to said at least one support hook, and thereby configured to receive a support hook of geometry similar to said at least one support hook therein.

15. The pipe handler of claim 10, wherein said pipe-receiving trough defines a trough first axis extending in a direction generally parallel to said pipe longitudinal movement within said pipe-receiving trough, and said pipe-receiving trough further comprises a trough bottom, trough side walls, and trough top edges distal in said trough from said trough bottom, said trough bottom extending parallel to said trough first axis by a distance greater than a distance of extent of said trough top edges parallel to said trough first axis.

16. The pipe handler of claim 15, wherein said rear face further comprises at least one removable fastener hole, and said front face further comprises at least one removable fastener hole generally aligned with said rear face at least one removable fastener hole.

17. A wedge configured to removably couple to an intermediate location within a pipe handler skidway and change the longitudinal direction of the skidway, comprising:

a wedge skidway having a pipe-receiving trough configured to cooperate with said pipe handler skidway and support pipes through longitudinal movement thereon;

a rear face rigidly affixed to an undersurface of said wedge skidway;

a front face spaced from said rear face and displaced from parallel to said rear face;

at least one support hook protruding from said front face;

at least one opening in said rear face complementary to said at least one support hook and configured to receive and engage with a support hook of like geometry to said at least one support hook;

wherein said rear face further comprises at least one hole, and said front face further comprises at least one hole generally aligned with said rear face at least one hole;

wherein said at least one rear face hole further comprises at least two rear face holes, and said at least one front face hole further comprises at least two front face holes; and at least one side rigidly affixed to an undersurface of said wedge skidway, affixed to said front face between said at least two front face holes, and affixed to said rear face between said at least two rear face holes.

18. The wedge of claim 17, wherein said at least one side further comprises a U-shaped geometry having a first lip affixed to said wedge skidway.

19. The wedge of claim 17, wherein said at least one support hook further comprises a hook shaft and a hook end angularly offset from said hook shaft, thereby defining an L-shaped geometry, said hook end displaced from said front face and thereby defining an engagement gap between said front face and said hook end.

20. The wedge of claim 19, wherein said at least one support hook further comprises a sloped taper at an end of said hook end distal to said hook shaft.

* * * * *